US007572995B2

(12) United States Patent
Hayakawa et al.

(10) Patent No.: US 7,572,995 B2
(45) Date of Patent: Aug. 11, 2009

(54) SWITCH MEMBER AND POWER WINDOW SWITCH DISPOSED WITH THE SWITCH MEMBER

(75) Inventors: Hideaki Hayakawa, Aichi-ken (JP); Hidetaka Nomura, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 588 days.

(21) Appl. No.: 11/480,930

(22) Filed: Jul. 6, 2006

(65) Prior Publication Data

US 2007/0008306 A1 Jan. 11, 2007

(30) Foreign Application Priority Data

Jul. 6, 2005 (JP) ..... 2005-197450

(51) Int. Cl.
*H01H 13/00* (2006.01)
*H01H 21/00* (2006.01)

(52) U.S. Cl. ..... 200/339; 200/553; 345/184

(58) Field of Classification Search ..... 345/156–184; D14/388, 398, 416; 200/329–345, 553–563; 307/9.1, 10.1

See application file for complete search history.

(56) References Cited

U.S. PATENT DOCUMENTS

| | | | | |
|---|---|---|---|---|
| 6,054,655 | A * | 4/2000 | Rudolph et al. | 200/339 |
| 6,459,420 | B1 * | 10/2002 | Harris | 345/161 |
| 2002/0171292 | A1 * | 11/2002 | Dinkel et al. | 307/10.1 |
| 2005/0051413 | A1 * | 3/2005 | Altmann | 200/339 |
| 2005/0109600 | A1 * | 5/2005 | Hishikawa | 200/339 |

FOREIGN PATENT DOCUMENTS

| | | |
|---|---|---|
| JP | 8-2898 | 11/1991 |
| JP | 2571578 | 8/1993 |
| JP | 2000/200522 | 7/2000 |

* cited by examiner

*Primary Examiner*—David L Lewis
(74) *Attorney, Agent, or Firm*—Roberts Mlotkowski Safran & Cole, P.C.; Thomas W. Cole

(57) ABSTRACT

A switch member comprising a convex knob portion on which the finger of an operator catches, wherein the knob portion is retained such that it is pivotable around a pivot shaft, a base surface of the knob portion is configured as a curved convex surface, wherein the curved convex surface is configured as a surface whose radius of curvature gradually becomes larger in a pulling direction of the finger catching on the knob portion, is provided.

16 Claims, 4 Drawing Sheets

SWITCH MEMBER AND POWER WINDOW SWITCH DISPOSED WITH THE SWITCH MEMBER

CROSS-REFERENCE TO RELATED APPLICATION

This application claims priority under 35 USC 119 from Japanese Patent Application No. 2005-197450, the disclosure of which is incorporated by reference herein.

BACKGROUND OF THE INVENTION

1. Field of the Invention

The present invention relates to a pivotable switch member that includes a convex knob portion on which the finger of an operator catches and to a power window switch disposed with the switch member.

2. Description of the Related Art

In recent years, power windows have come to be installed in many automobiles. Such power windows include a power window switch with which an operator can open and close the power window using his/her finger.

As disclosed in Japanese Patent Application Publication No. 2000-200522, Japanese Utility Model Registration No. 2,571,578 and Japanese Utility Model Application Publication No. 1996-2898, for example, a switch member that includes a convex knob portion on which the finger of an operator catches is disposed on the inner side of a door. The switch member is attached to the door such that the switch member pivots when the knob portion is pulled by the finger of the operator.

However, there has been the problem that sometimes the finger of the operator slips off the switch member while the operator is operating the switch member. This problem occurs particularly frequently when the operator has long fingernails.

As a measure to counter this problem, it is conceivable to form a deeply gouged portion for the operator to insert his/her finger, but in this case there is the drawback that the size of the switch mechanism becomes larger.

SUMMARY OF THE INVENTION

The present invention has been made in view of the above circumstances and provides a switch member comprising a convex knob portion on which the finger of an operator catches, wherein the knob portion is retained such that it is pivotable around a pivot shaft, a base surface of the knob portion is configured as a curved convex surface, wherein the curved convex surface is configured as a surface whose radius of curvature gradually becomes larger in a pulling direction of the finger catching on the knob portion. The present invention also provides a power window switch disposed with the switch member.

BRIEF DESCRIPTION OF THE DRAWINGS

A preferred embodiment of the present invention will be described in detail based on the following figures, wherein.

DETAILED DESCRIPTION OF THE INVENTION

The present invention will be described below by way of an exemplary embodiment.

Figure 1:
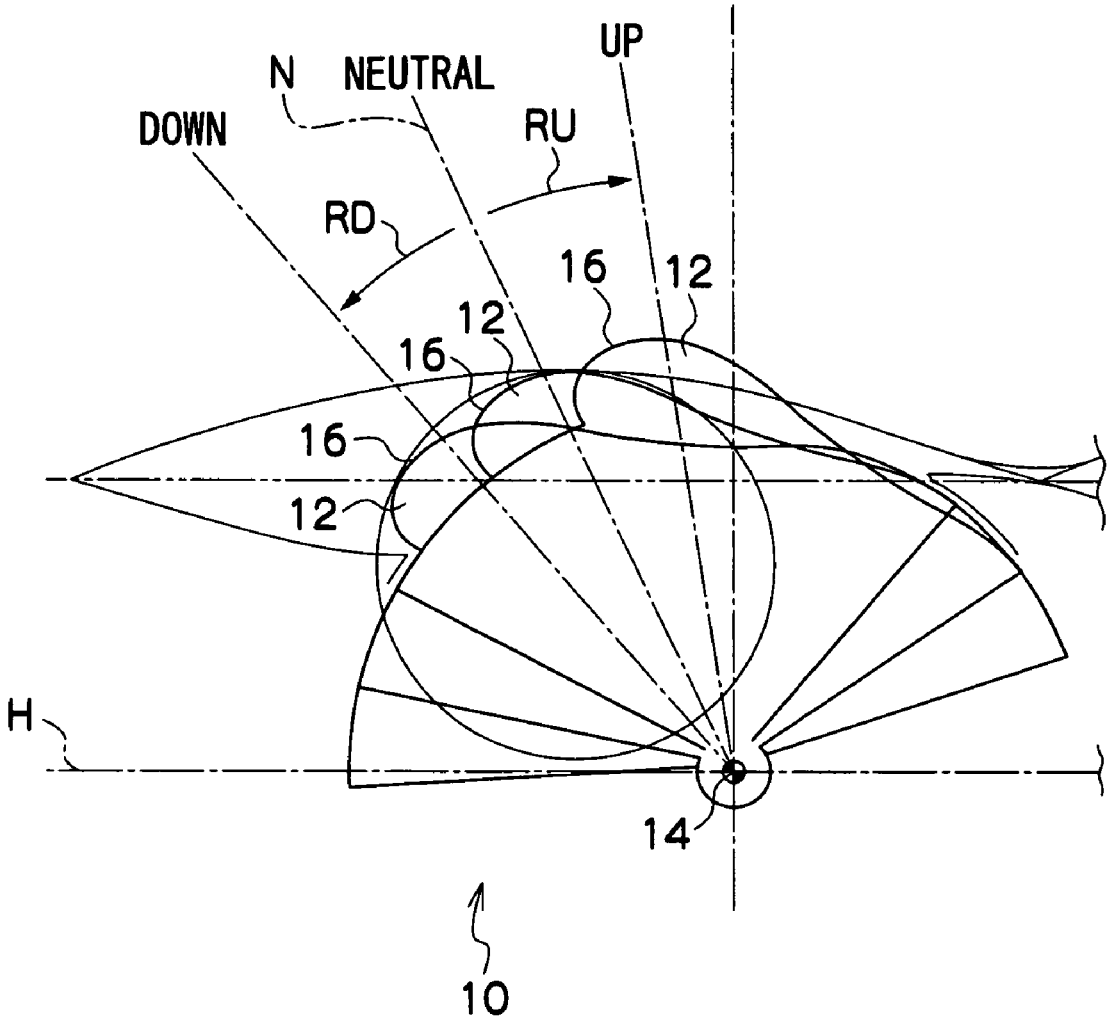
FIG. 1 is a schematic side view showing the configuration of a switch member pertaining to the embodiment of the invention.
Figure 2A:
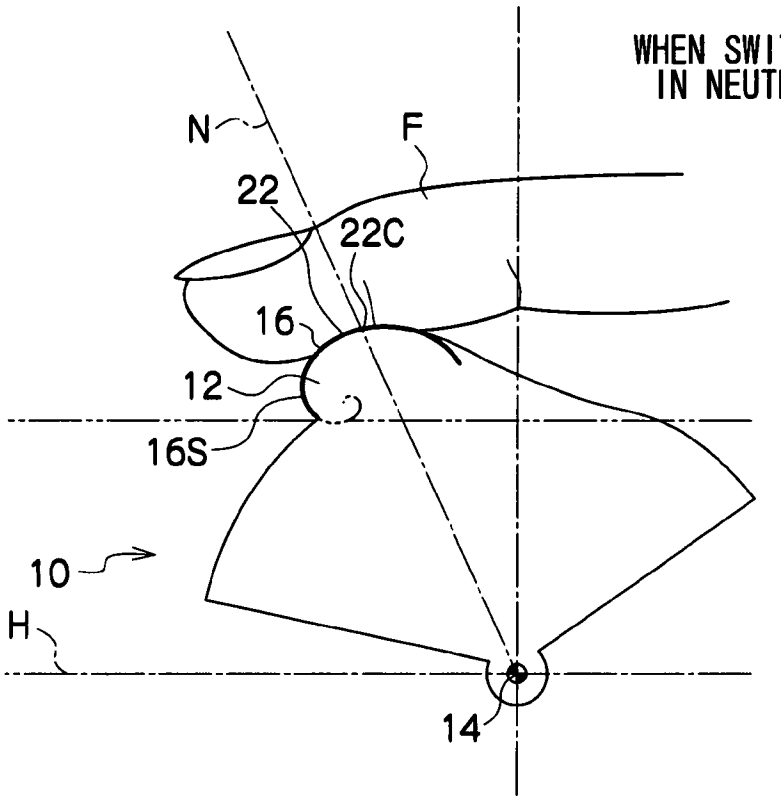
FIG. 2A is a schematic side view of the switch member pertaining to the embodiment of the invention showing a state where the finger of an operator contacts the switch member in a neutral position (when the switch member is not being operated)
Figure 2B:
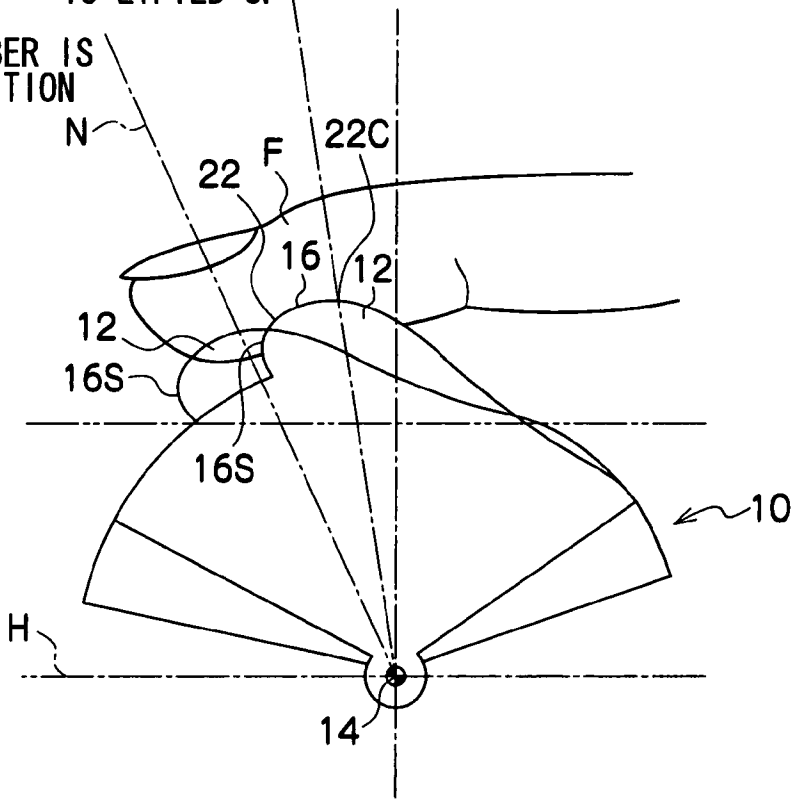
FIG. 2B is a schematic side view of the switch member pertaining to the embodiment of the invention showing a state where the finger of an operator contacts and lifts up the switch member.

As shown in FIG. 1 and FIGS. 2A and 2B, a switch member 10 pertaining to the embodiment of the invention is a member that configures a power window switch.

A convex knob portion 12 on which the finger (typically the index finger) F of a passenger catches is formed on the switch member 10. The switch member 10 is configured to pivot around a pivot shaft 14 when the knob portion 12 is pulled in a rearward direction RU (a pulling direction, which is the direction "UP") and when the knob portion 12 is pushed in a frontward direction RD (a pushing direction, which is the direction "DOWN") (see FIG. 1).

Figure 3:
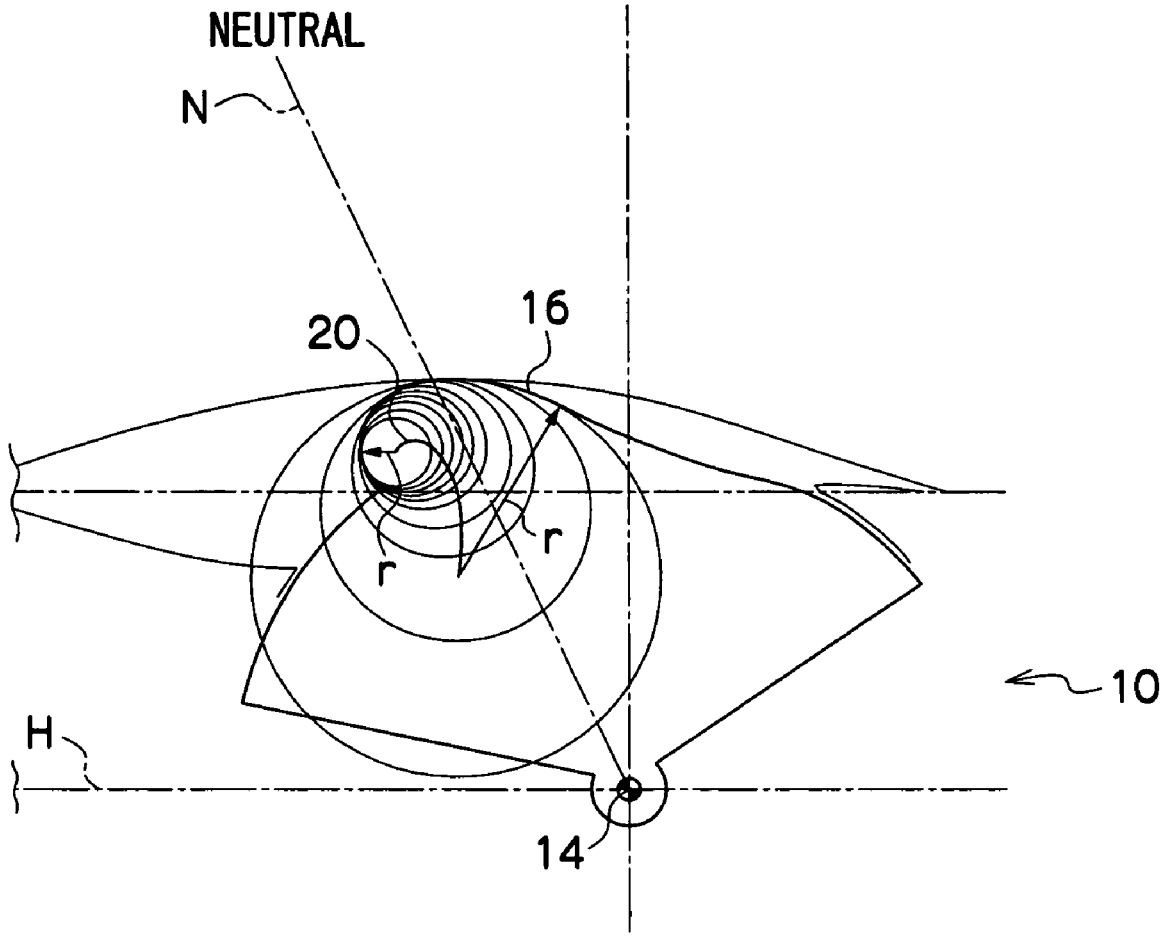
FIG. 3 is a schematic side view showing the switch member pertaining to the embodiment of the invention, and shows that a curve leading through the center of curvature of a base surface is an involute curve.

The knob portion 12 includes a base surface 16 that is formed as a curved convex surface and is disposed where the finger F contacts the knob portion 12. As shown in FIG. 3, the base surface 16 is configured such that its radius of curvature r gradually becomes larger from its front side (RD side) toward its rear side (RU side). A line 20 leading through the radial center of the radius of curvature r, that is, a line 20 leading through the center of curvature of the base surface 16 draws a trajectory of an involute curve approaching the design surface. The radius of curvature of the involute curve becomes smaller as it approaches the fingertip of the finger F contacting the base surface 16.

Due to this configuration, a contact portion 22 of the base surface 16 that the finger F contacts is gradual because its radius of curvature is large when the passenger begins operating the switch member 10 and becomes steep because its radius of curvature becomes smaller as the passenger operates the switch member 10.

Consequently, a soft sense of touch is imparted to the finger F when the passenger begins operating the switch member 10. Further, the knob portion 12 is lifted up when the passenger finishes pulling the switch member 10. For this reason, it is difficult for the finger F to slip off the knob portion 12. Consequently, the passenger can reliably pull up the switch member 10 by pulling the switch member 10 horizontally, and operational mistakes such as the finger F slipping off the knob portion 12 do not arise.

As described above, in the present embodiment, the base surface 16 is configured as the above-described surface, and the line 20 leading through the center of curvature of the base surface 16 draws an involute curve. Thus, the switch member 10 is easy to be used and can be reliably operated without having to increase its size. Further, it is not necessary to form the conventional gouged portion in the switch member 10 in order for the passenger to insert his/her finger F.

EXAMPLE

Figure 4:
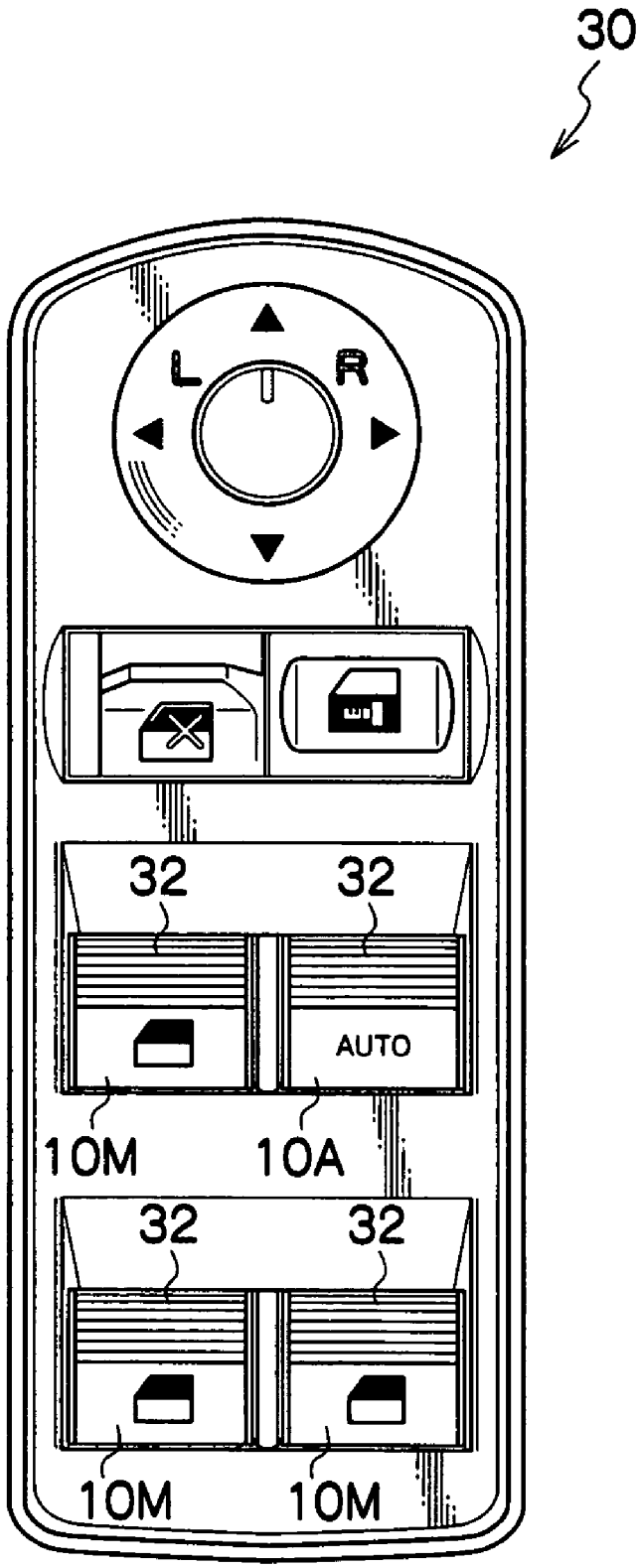
FIG. 4 is a plan view of the switch member described in an example.

The present invention will be described in greater detail below by way of an example of the above-described embodiment. As shown in FIG. 4, in a power window switch 30 of the present example, nonslip portions 32 are formed on the sides (surfaces) of the base surfaces 16 contacted by the finger F. Ridges along the pivot shafts 14 are alternately formed in the nonslip portions 32, and are configured such that they have a crenellated shape when seen in a cross section orthogonal to the pivot shafts 14.

Thus, when the passenger is either pulling the switch member 10 in the rearward direction RU or pushing the switch member 10 in the frontward direction RD with his/her finger F, it becomes more difficult for the finger F of the passenger to slip off the knob portion 12.

In the present example, the distance from the pivot shaft 14 to a center contact portion 22C in the center of the contact portion 22 is 20 mm. Additionally, the radius of curvature r of a front end portion 16S of the base surface 16 (see FIGS. 2A and 2B) is set to be within the range of 5.0 to 7.5 mm. As a result, when the passenger finishes pulling the switch member 10, the contact position of the finger F moves near the front end portion 16S of the base surface 16 and an appropriate pushing force acts between the knob portion 12 and the finger F. In the present example, the operational load acting on the switch member 10 is about 5 N when the passenger either pulls the switch member 10 in the rearward direction RU or pushes the switch member 10 in the frontward direction RD.

In the present example, the angles in which the knob portion 12 can pivot are configured to be the same angle both frontward and rearward around a neutral position where force is not imparted. These pivotable angles will be described below in regard to an automatic switch member 10A and manual switch members 10M that configure the power window switch 30.

In both the switch member 10A and the switch members 10M, a plane N that joins the center contact portion 22C and the pivot shaft 14 in the neutral position forms an angle of 65 degrees with respect to a horizontal plane H.

In the switch member 10A, the range of the pivot angle during manual operation (where the opening or closing of the window immediately stops when the passenger releases his/her finger F from the switch member 10A) is as much as 10 degrees both frontward and rearward from the neutral position. The range of the pivot angle during automatic operation (where the opening or closing of the window continues until the window is completely opened or closed even when the passenger releases his/her finger F from the switch member 10A) is as much as an additional 6 degrees both frontward and rearward from the position where automatic operation ends.

In the switch members 10M, the range of the pivot angle is as much as 14 degrees both frontward and rearward from the neutral position.

According to the present example, a power window switch that is easy to be operated can be realized.

Although a mode of implementing the invention has been described above by way of an embodiment, the preceding embodiment is only one example and can be variously changed and implemented within a range that does not depart from the spirit of the present invention. The scope of rights of the present invention is of course not limited to the preceding embodiment.

What is claimed is:

1. A switch member comprising a convex knob portion on which the finger of an operator catches, wherein the knob portion is retained such that it is pivotable around a pivot shaft, a base surface of the knob portion is configured as a curved convex surface, and the curved convex surface is configured as a surface whose radius of curvature gradually becomes larger in a pulling direction of the finger catching on the knob portion.

2. The switch member of claim 1, wherein a nonslip portion is formed on an outer surface of the base surface.

3. The switch member of claim 1, wherein a line leading through the center of curvature of the curved convex surface draws an involute curve, and the radius of curvature of the involute curve becomes smaller as it approaches the tip of the finger contacting the curved convex surface.

4. The switch member of claim 2, wherein a line leading through the center of curvature of the curved convex surface draws an involute curve, and the radius of curvature of the involute curve becomes smaller as it approaches the tip of the finger contacting the curved convex surface.

5. A power window switch disposed with the switch member of claim 1.

6. A power window switch disposed with the switch member of claim 2.

7. The power window switch of claim 5, wherein pivotable angles of the knob portion of the switch member are the same angles both frontward and rearward around a neutral position where force is not imparted.

8. The power window switch of claim 6, wherein pivotable angles of the knob portion of the switch member are the same angles both frontward and rearward around a neutral position where force is not imparted.

9. A switch member comprising:

a switch body;

a knob portion integrally formed with the switch body; and a pivot shaft serving as a pivot center of the knob portion, wherein the knob portion is configured to have a convex shape on which the finger of an operator catches, a base surface of the knob portion is configured as a curved convex surface, and the curved convex surface is configured as a surface whose radius of curvature gradually becomes larger in a pulling direction of the finger catching on the knob portion.

10. The switch member of claim 9, wherein a nonslip portion is formed on an outer surface of the base surface.

11. The switch member of claim 9, wherein a line leading through the center of curvature of the curved convex surface draws an involute curve, and the radius of curvature of the involute curve becomes smaller as it approaches the tip of the finger contacting the curved convex surface.

12. The switch member of claim 10, wherein a line leading through the center of curvature of the curved convex surface draws an involute curve, and the radius of curvature of the involute curve becomes smaller as it approaches the tip of the finger contacting the curved convex surface.

13. A power window switch disposed with the switch member of claim 9.

14. A power window switch disposed with the switch member of claim 10.

15. The power window switch of claim 13, wherein pivotable angles of the knob portion of the switch member are the same angles both frontward and rearward around a neutral position where force is not imparted.

16. The power window switch of claim 14, wherein pivotable angles of the knob portion of the switch member are the same angles both frontward and rearward around a neutral position where force is not imparted.

* * * * *